US006718582B1

(12) United States Patent
Tinsley

(10) Patent No.: US 6,718,582 B1
(45) Date of Patent: Apr. 13, 2004

(54) PADDED FACE REST WITH DOUBLE PIVOTING ADJUSTMENT MECHANISM

(76) Inventor: Ronald E. Tinsley, 2944 Adams St., Eugene, OR (US) 97405

( * ) Notice: Subject to any disclaimer, the term of this patent is extended or adjusted under 35 U.S.C. 154(b) by 0 days.

(21) Appl. No.: 10/447,496

(22) Filed: May 28, 2003

Related U.S. Application Data

(60) Provisional application No. 60/385,217, filed on May 31, 2002.

(51) Int. Cl.[7] ..... A47C 20/04

(52) U.S. Cl. ..... 5/640; 5/636; 5/638

(58) Field of Search ..... 5/622, 636, 638, 5/640, 643; 297/408, 409

(56) References Cited

U.S. PATENT DOCUMENTS 5,177,823 A * 1/1993 Riach
5,401,078 A * 3/1995 Riach ..... 297/423.11
5,427,436 A * 6/1995 Lloyd ..... 297/408
6,397,414 B1 * 6/2002 Lloyd ..... 5/622

* cited by examiner

*Primary Examiner*—Teri Pham Luu
(74) *Attorney, Agent, or Firm*—Robert E. Howard

(57) ABSTRACT

A padded face rest having a single cam lock, double pivoting adjustment mechanism. The adjustment mechanism includes a pair of cantilever members, each cantilever member being comprised of a pair of spaced apart, substantially parallel cantilever plates having locking members at each end. One of the locking members is adapted to lockingly engage a locking member attached to the padded face rest, and the other locking member is adapted to lockingly engage a locking member attached to the face rest attachment frame. A locking rod extends through the mid-portion of all of the cantilever plates. A cam clamp is attached to an end of the locking rod and, upon rotation, causes the plates of each cantilever member to be pulled towards each other to thereby lockingly engage adjacent locking members.

1 Claim, 5 Drawing Sheets

PADDED FACE REST WITH DOUBLE PIVOTING ADJUSTMENT MECHANISM

CROSS-REFERENCE TO RELATED APPLICATIONS

This application claims the benefit of U.S. Provisional Application No. 60/385,217 filed May 31, 2002.

BACKGROUND OF THE INVENTION

The present invention relates to a padded face rest with a double pivoting adjustment mechanism.

Padded face rests are attached to body treatment devices, such as massage chairs and massage tables, with the user placing his or her face against the pad of the face rest. The pad and its supporting frame are typically an inverted U-shape to allow the user to have his or her eyes, mouth and nose exposed. Such padded face rests are typically movable at two pivot points to allow adjustment of both the angle and the elevation of the padded face rest to the horizontal to enable proper positioning for users of different sizes.

U.S. Pat. No. 5,177,823 describes an adjustable headrest that uses cam clamps at both of the pivot points. Although such an adjustment mechanism is suitable, it would be desirable to have a more simple adjustment mechanism to allow adjustment to be made more quickly.

SUMMARY OF THE PRESENT INVENTION

The present invention provides a padded face rest and adjustment assembly that employs a single cam clamp adjustment mechanism that allows adjustment at both pivot points.

The padded face rest and adjustment assembly of the present invention is for use with body treatment devices. The assembly includes a padded, face rest subassembly, a treatment device attachment subassembly, and a double pivoting adjustment subassembly.

The padded face rest subassembly includes a face pad attached to a face pad support frame. A pair of spaced apart flanged support rails are attached to the lower surface of the face pad support frame. A round locking member having radially extending teeth is attached to the outer side walls at the inner ends of each of the flanges of the flanged rail members.

The treatment device attachment subassembly includes an attachment frame for attaching the assembly to a treatment device. The frame has a U-shaped face rest attachment yoke attached at its base to the outer surface of the attachment frame with the legs of the attachment yoke extending outwardly. A round locking member having radially extending teeth is attached to the outer side walls at the outer ends of each of the attachment yoke legs.

The double pivoting adjustment mechanism includes a pair of cantilever members, each cantilever member being comprised of a pair of spaced apart, substantially parallel cantilever plates. Both inwardly facing surfaces at the ends of each of the outer cantilever plates have a round locking member with radially extending teeth attached thereto or integral therewith. The teeth of one of the locking members is adapted to mesh with teeth of the adjacent locking member attached to the flange of the padded face rest, and the teeth of the other locking member is adapted to mesh with the teeth of the adjacent locking member attached to the leg of the attachment member yoke. A locking rod extends through the mid-portion of all of the cantilever plates and is retained at one end against the adjacent plate by a lock nut or similar means. A cam clamp is attached to the other end of the locking rod and is adapted to cause the plates of each cantilever member to be pulled towards each other,to thereby engage the teeth of all four sets of the round locking members.

DESCRIPTION OF THE PREFERRED EMBODIMENTS

The padded face rest and adjustment assembly 10 of the present invention includes a padded face rest (cradle) subassembly 20, a user device attachment subassembly 30, and left and right cantilever members 40, 40', respectively.

Figure 1:
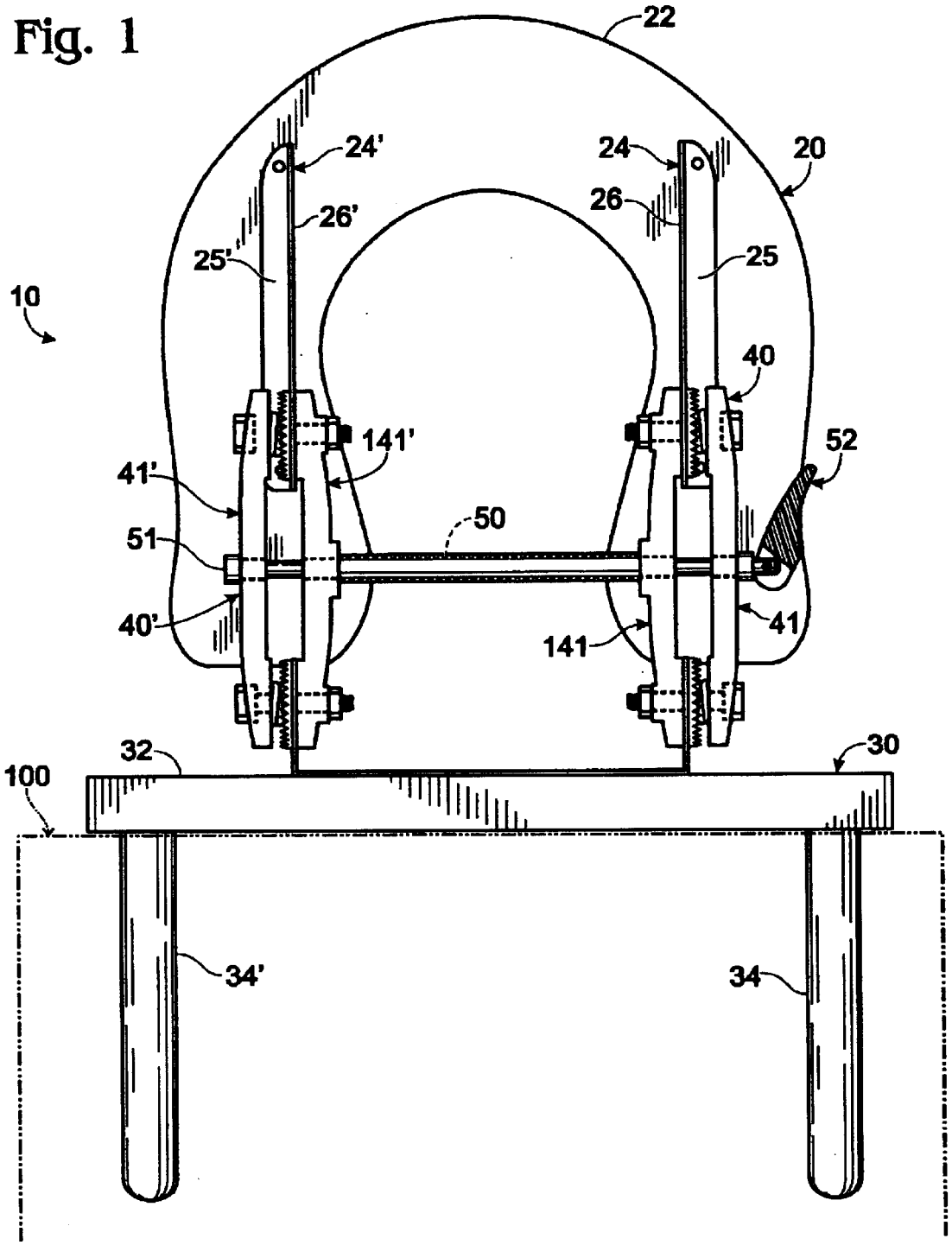
FIG. 1 is a bottom plan view of the padded face rest and adjustment assembly of the present invention with the padded face rest subassembly shown rotated into a horizontal position.
Figure 2:
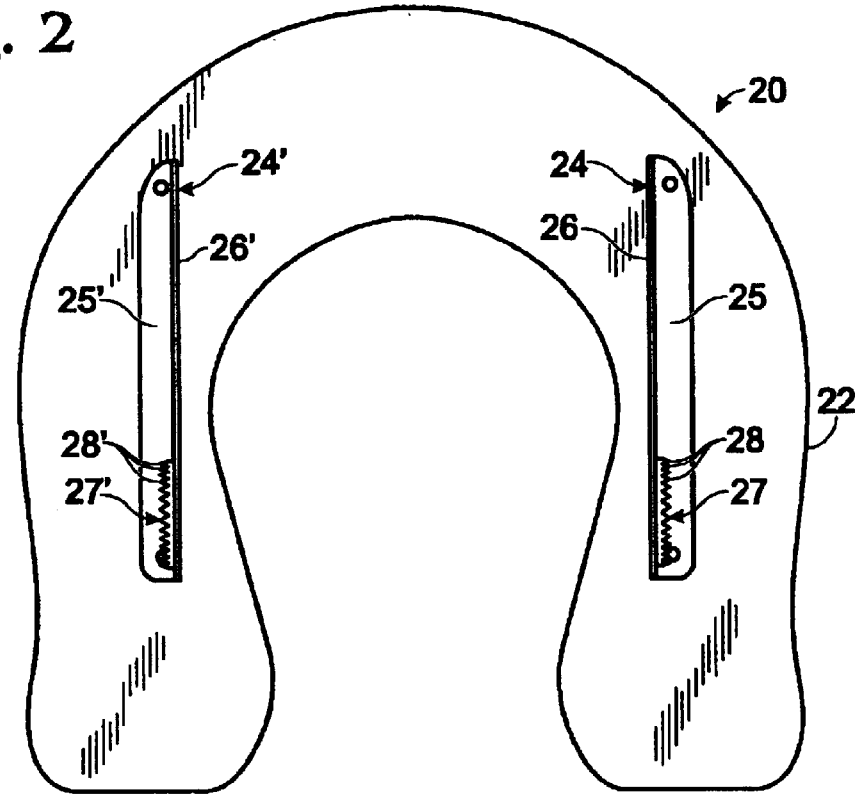
FIG. 2 is a bottom plan view of the padded face rest subassembly of the padded face rest and adjustment assembly of the present invention.
Figure 3:
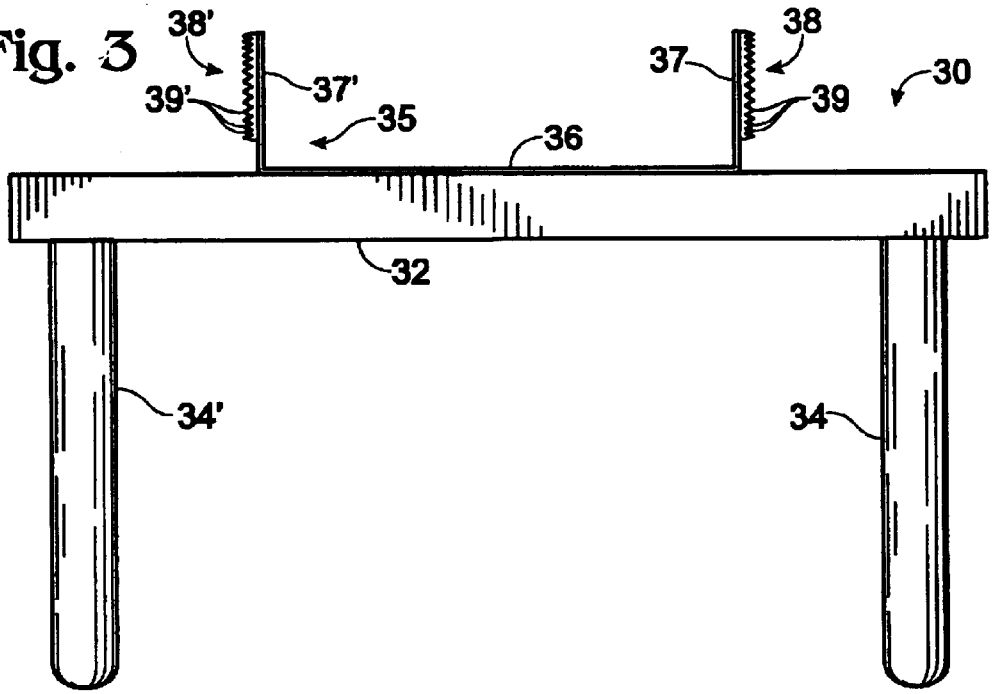
FIG. 3 is a bottom plan view of the treatment attachment subassembly of the padded face rest and adjustment assembly of the present invention.
Figure 4:
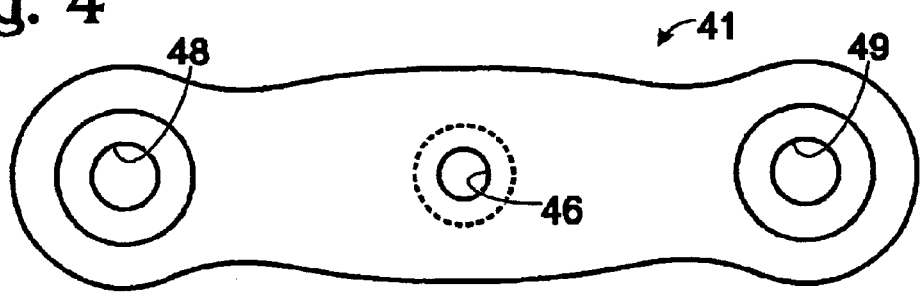
FIG. 4 is a top plan view of an outer cantilever plate of the padded face rest and adjustment assembly of the present invention.
Figure 5:
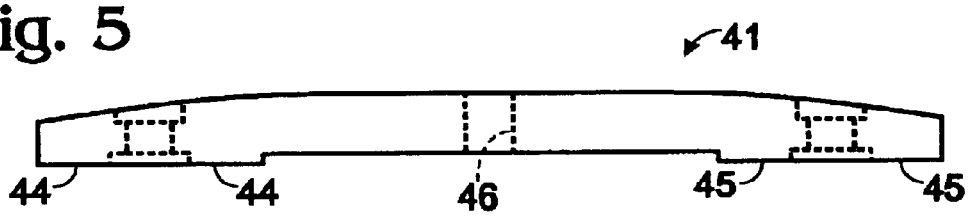
FIG. 5 is a side elevation view of an outer cantilever plate of the padded face rest and adjustment assembly of the present invention.
Figure 6:
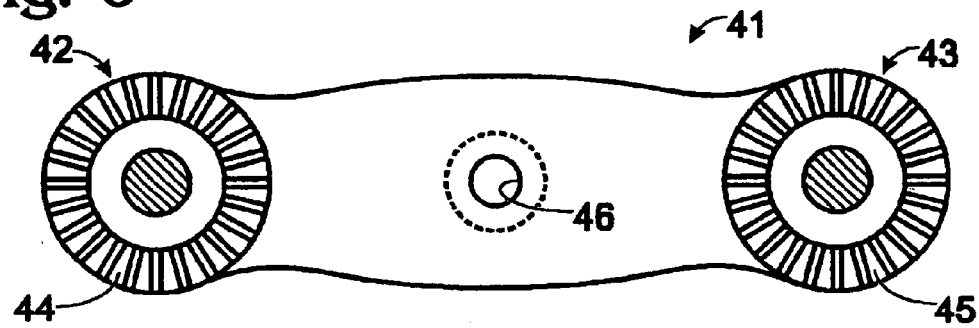
FIG. 6 is a bottom plan view of an outer cantilever plate of the padded face rest and adjustment assembly of the present invention.
Figure 7:
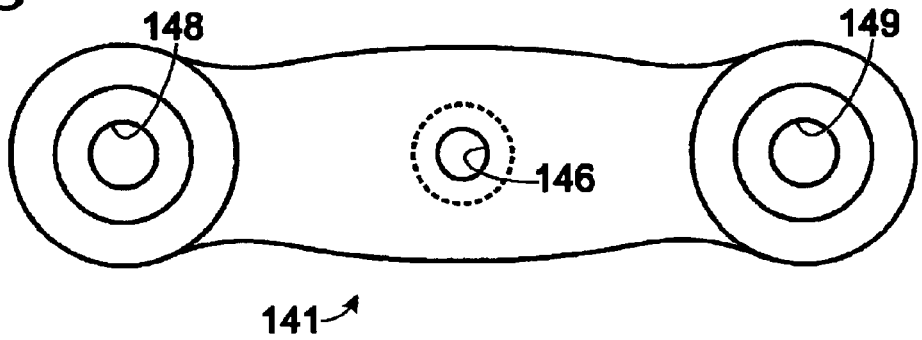
FIG. 7 is a bottom plan view of an inner cantilever plate having no locking members of the padded face rest and adjustment assembly of the present invention.

Padded face rest subassembly 20 includes an inverted U-shaped pad support frame 22 having upper and lower planar surfaces, the lower planar surface being shown in FIGS. 1 and 2.

Figure 11:
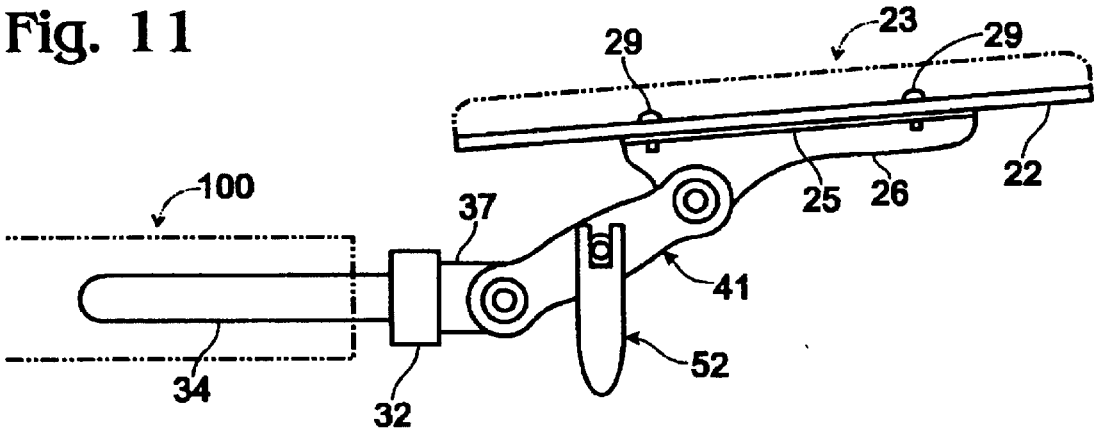
FIG. 11 is a side elevation view of the padded face rest and adjustment assembly of the present invention, with the padded face rest shown in an elevated and inclined position.

An inverted U-shaped face pad 23 is attached to the upper planar surface of the pad frame 22, as shown in phantom in FIG. 11.

A pair of flanged support rails 24, 24' are substantially parallel and extend from a frontal portion of pad support frame rearwardly along each leg thereof. Each flanged support rails 24, 24' include a base plate 25, 25' and a downwardly extending flange 26, 26', respectively. Base plates 25, 25' are attached to the lower planar surface (underside) of pad support frame 22 by any suitable means, such as threaded fasteners 29.

Round locking members 27, 27' are attached to the outer surface of the inner ends of flanges 26, 26' of support rails 24, 24', respectively. Round locking members 27, 27' are identical, and each has a plurality of radial, outwardly extending teeth 28, 28', respectively.

A body treatment device attachment subassembly 30 includes an attachment frame 32 having an inner and outer surface. Body treatment device attachment rods 34, 34' extend outwardly from the inner surface of frame 32. Attachment rods 34, 34' are adapted to be received into the face rest locking recesses of a conventional body treatment device, such as massage table 100 partially shown in phantom in FIGS. 1 and 11, and clamped into place by conventional clamping members, not shown.

A U-shaped yoke 35 has a base 36 attached to the outer surface of frame 32, and outwardly extending legs 37, 37'. Round locking members 38, 38' are attached to the upper outer surface of legs 37, 37', respectively. Round locking members 38, 38' are identical to each other and identical to rounded locking members 27, 27'. Each round locking member 38, 38' has a plurality of radial, outwardly extending teeth 39, 39', respectively.

Figure 8:
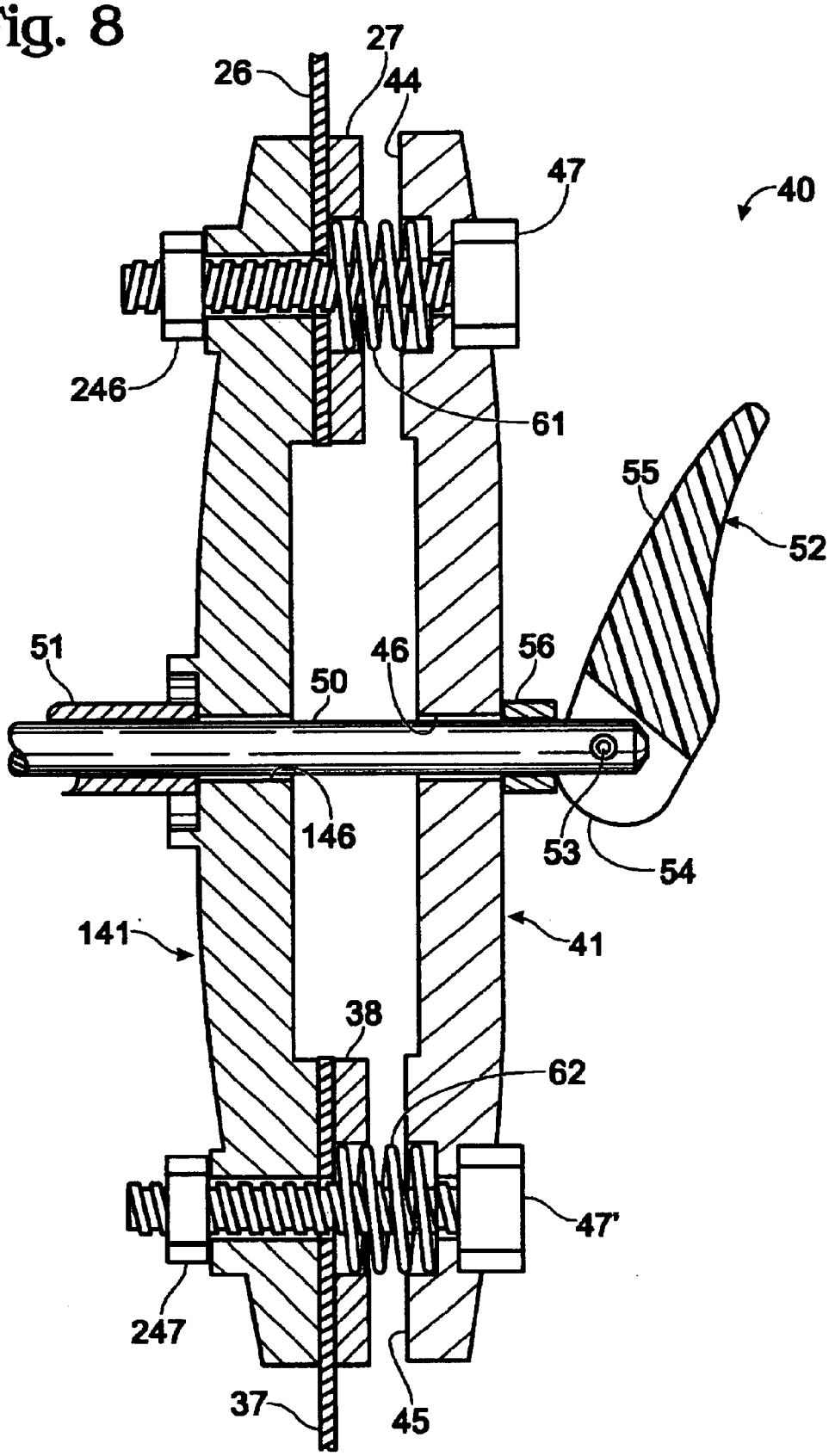
FIG. 8 is bottom plan view of one of the cantilevered cam clamp adjustment subassemblies of the padded face rest and adjustment assembly of the present invention.

Left cantilever member 40 is shown in an enlarged view in FIG. 8. Although the following discussion will be with regard to left cantilever member 40, right cantilever member 40' is identical in construction, being a mirror image of left cantilever member 40.

Left cantilever member 40 includes a pair of spaced apart, substantially parallel outer and inner cantilever plates 41 and 141, respectively. Cantilever plates 41 and 141 are shown in more detail in FIGS. 4–7.

The inwardly facing ends of outer cantilever plate 41 have round locking members 42 and 43 formed therein. Round locking members 42 and 43 are identical in construction and include radially extending teeth 44 and 45, respectively. The teeth 44 of round locking member 42 are adapted to mesh with teeth 28 of the round locking member 27 attached to the flange 26 of the padded face rest subassembly 20. The teeth 45 of the other round locking member 43 are adapted to mesh with the teeth 39 of the round locking member 38 attached to the leg 37 of attachment member yoke 35.

A threaded fastening member, such as bolt 47, passes through a centrally located opening 48 in cantilever plate 41, through aligned openings in flange 26,and round locking member 27, and through a centrally located opening 148 in cantilever plate 141. Similarly, a threaded fastening member, such as bolt 47', passes through a centrally located opening 49 in cantilever plate 41, through aligned openings in leg 37 and round locking member 38, and through a centrally located opening 149 in cantilever plate 141. Nuts 246 and 247 are attached to the outer ends of bolts 46 and 47, respectively. The distance between nuts 246 and 247 and the heads of bolts 46 and 47, respectively, is such as to allow the teeth of locking members 42 and 27, and locking members 43 and 38, respectively, to be kept in a disengaged (unlocked) position (as seen in FIG. 8) by virtue of the action of spring members 61 and 62 pushing thereagainst.

A locking rod 50 extends through openings 46 and 146 located in the mid-portion of outer and inner cantilever plates 41 and 141, respectively. Locking rod 50 is retained at one end against the adjacent outer cantilever plate 41' by a lock nut 51 or similar retaining means. A cam clamp 52 is pivotally attached by pin member 53 to the other end of locking rod 50. Cam clamp 52 includes a rounded head portion 54 that has a cam surface. A lever 55 extends outwardly from the head portion 54.

Figure 9:
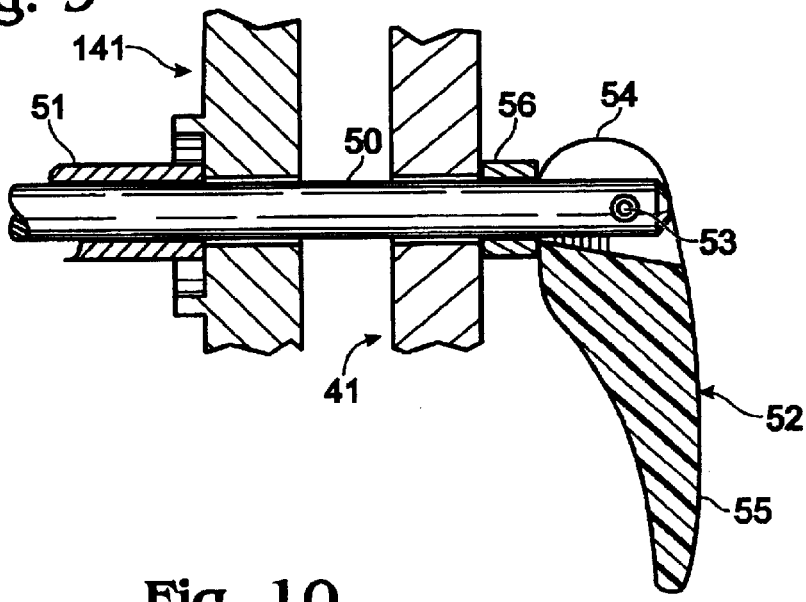
FIG. 9 is a bottom plan view of the cam clamp and locking rod of the padded face rest and adjustment assembly of the present invention, the cam clamp being shown in its locked position.
Figure 10:
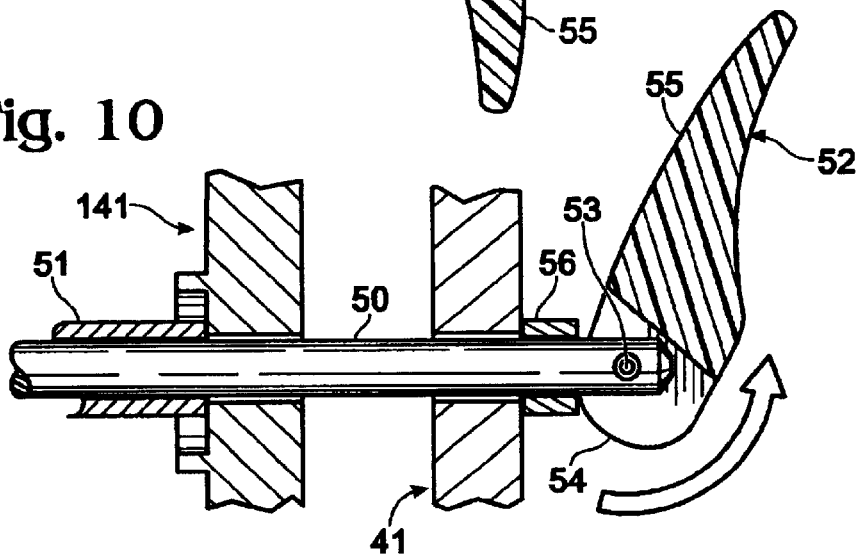
FIG. 10 is a bottom plan view of the cam clamp and locking rod of the padded face rest and adjustment assembly of the present invention, the cam clamp being shown in its unlocked position.

Rounded head portion 54 of cam clamp 52 abuts against a plastic washer (anvil) 56. Cam clamp 52 is in its unlocked position as seen in FIGS. 1, 8 and 10. Rotating camp clamp handle 55 downwardly to the locked position shown in FIG. 9 causes the cam surface of rounded head portion 54 to push against anvil 56, thereby causing cantilever plates 41 and 141, and cantilever plates 41' and 141', to be pulled towards each other against the action of springs 61 and 62. This locking action causes the teeth of adjacent round locking members 27 and 44, 38 and 45, and their counterparts associated with cantilever plates 41' and 141', to become engaged (locked) and thereby prevent pivoting of the various cantilever plates about rains 26 and 26' and about legs 37 and 37' of yoke 35.

The entire cam clamp adjustment subassembly of the present invention includes left and right cantilever members 40 and 40', locking rod 50, and cam clamp 52.

In use, padded face rest assembly 10 is attached to a body treatment device 100 by inserting attachment rods 34 into associated openings in device 100 and clamping the rods in place by means of conventional clamping members (not shown). Cam lock 52 can be unlocked from the locked position shown in FIG. 9 by moving handle 52 in the direction of the arrow shown in FIG. 10. Once unlocked, the action of springs 61 and 62 forces adjacent cantilever plates apart a distance sufficient to disengage (unlock) the teeth of adjacent round locking members, thereby allowing padded face rest subassembly 20 to be pivotally moved to any suitable position, such as that shown in FIG. 11.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A padded face rest and adjustment assembly for use with a body treatment device comprising:

a padded face rest subassembly including a face pad adapted to receive a user's face, a pad support frame having an upper and lower surface, said face pad being attached to said upper surface of said pad support frame, first and second substantially parallel, spaced apart rails attached to said lower surface of said pad support frame, each of said rails having a locking member attached thereto;

a body treatment device attachment subassembly including an attachment frame having an inner and outer surface, means extending from said inner surface of said attachment frame adapted to attach said attachment frame to a body treatment device, a pair of substantially parallel legs extending from said outer surface of said attachment frame, said legs being spaced apart a distance that is substantially equal to the distance said rails are spaced apart, each of said legs having a locking member attached thereto;

a cam clamp adjustment subassembly including first and second substantially parallel cantilever members, each of said first and second cantilever members being comprised of first and second spaced apart, substantially parallel, cantilever plates having first and second ends, each of said first cantilever plates having a first locking member at said first end and a second locking member at said second end, said first locking member of said first cantilever plate of said first cantilever member adapted to be brought into contact with and lockingly engage said locking member attached to said first rail of said padded face rest, said first locking member of said first cantilever plate of said second cantilever member adapted to be brought into contact with and lockingly engage said locking member attached to said second rail of said padded face rest, said second locking member of said first cantilever plate of said first cantilever member adapted to be brought into contact with and lockingly engage a locking member attached to said first leg of said face rest attachment frame, said second locking member of said first cantilever plate of said second cantilever member adapted to be brought into contact with and lockingly engage a locking member attached to said second leg of said face rest attachment frame, a locking rod having first and second ends, said locking rod extending through the mid-portion of all of said cantilever plates, a cam clamp attached to said first end of said locking rod, said cam clamp having a cam surface in abutment with said first cantilever plate of said first cantilever member, spring means extending between the first and second ends of said first and second cantilever plates of each of said first and second cantilever members, said spring means urging apart said first and second plates of each of said first and second cantilever members when said cam surface of said cam clamp is in an unlocked mode, sid cam surface adapted, upon rotation, to cause said first and second plates of each of said first and second cantilever members to be pulled towards each other to thereby lockingly engage adjacent locking members.

* * * * *